United States Patent [19]

Treillet

[11] Patent Number: 4,993,255

[45] Date of Patent: Feb. 19, 1991

[54] DEVICE FOR FIXING AN ELONGATED PART SUCH AS PUNCH, DIE OR SIMILAR TOOL ON THE PLATEN OF A BENDING-PRESS

[75] Inventor: Jean P. H. Treillet, Boulogne-Billancourt, France

[73] Assignee: Amada, Saint-Denis, France

[21] Appl. No.: 482,975

[22] Filed: Feb. 22, 1990

[30] Foreign Application Priority Data

Mar. 2, 1989 [FR] France ..... 89 02694

[51] Int. Cl.[5] ..... B21D 37/14

[52] U.S. Cl. ..... 72/462; 72/481; 72/389; 269/91; 269/94; 269/229; 269/238

[58] Field of Search ..... 72/389, 462, 481; 269/60, 91, 93, 94, 229, 231, 238, 239

[56] References Cited

U.S. PATENT DOCUMENTS

| | | | |
|---|---|---|---|
| 2,755,758 | 7/1956 | Johansen | 72/462 |
| 4,590,788 | 5/1986 | Wallis | 72/462 |
| 4,598,574 | 7/1986 | Hegel et al. | 72/462 |
| 4,787,237 | 11/1988 | Houston et al. . | |
| 4,895,014 | 1/1990 | Houston | 72/462 |

FOREIGN PATENT DOCUMENTS

| | | | |
|---|---|---|---|
| 0237800 | 9/1987 | European Pat. Off. . | |
| 3524694 | 12/1988 | Fed. Rep. of Germany . | |
| 2339485 | 8/1977 | France . | |
| 54524 | 3/1987 | Japan | 72/481 |
| 267019 | 11/1987 | Japan | 72/481 |
| 1175602 | 8/1985 | U.S.S.R. | 72/481 |
| 2057047 | 3/1981 | United Kingdom . | |

*Primary Examiner*—David Jones

*Attorney, Agent, or Firm*—Young & Thompson

[57] ABSTRACT

A bending-press tool can be fixed instantaneously on its tool-holder by means of a device which permits positioning and extraction of the tool on the front side of the machine without any need to displace adjacent tools. The device comprises a clamping member pivotally mounted on a longitudinal shaft and having a shouldered portion, the heel of the tool which has a suitable shape being intended to engage on the shouldered portion. After engagement, the tool is thrust from its position of equilibrium towards the rear, causes rotational displacement of the clamping member and of a locking cam which has the effect of applying the clamping member on the tool in the work position. In order to unclamp the tool, it is only necessary to withdraw the cam. The tool then remains engaged and can be extracted by pivotal displacement in the forward direction.

9 Claims, 2 Drawing Sheets

DEVICE FOR FIXING AN ELONGATED PART SUCH AS PUNCH, DIE OR SIMILAR TOOL ON THE PLATEN OF A BENDING-PRESS

BACKGROUND OF THE INVENTION

The present invention relates to a device for instantaneous fixing in accordance with safety standards for various parts of elongated shape and in particular for bending tools which are intended to be fixed on the platen of a bending-press.

By way of example, the tool can be a bending-press punch or die which is securely attached or fixed to the platen or to one or a number of intermediate tool-holders. The tool must be adapted to operations performed on the bending-press and therefore has to be changed at frequent intervals.

In the majority of instances, the tool has a heel applied against a vertical face of the tool-holder by means of clamps and a plurality of screws. When it is suspended, the tool must be prevented from falling in the event of slackening-off. To this end, the heel can be provided with a grooved or shouldered portion whilst the clamps have an inverse shape. In this case, the heel can be mounted or extracted only laterally by sliding, which is subject to disadvantages, in particular when other tools are located on each side of the tool to be changed.

Moreover, the time required to tighten-up all the screws is considerable. As a palliative measure, the screws can be replaced by hydraulic or pneumatic systems as described in French Pat. No. 2 339 485 and German Pat. No. 35 24 694. This does permit a saving of time in the tightening operation but does not overcome the difficulties involved in extraction of the tool. In addition, these devices are expensive and exacting in their requirements since they have to meet strict safety standards in order to guard against the danger of falling as a result of accidental leakage of fluid.

For the reasons just given, the present invention is intended to provide a tool-fixing device which offers every guarantee of operational safety, which permits front introduction in the position of attachment and which ensures instantaneous clamping by means of a simple movement exerted by the operator in order to tilt the tool to its work position, thus initiating automatic locking of the clamping member as a result of this movement.

SUMMARY OF THE INVENTION

The invention is accordingly concerned with a device for rigidly fixing a part of elongated shape such as a punch or die or similar tool on the platen of a bending-press or on intermediate tool-holders of the type comprising a movable clamping member placed opposite to one of the faces of the corresponding support and capable of clamping the fixing heel of the tool against said face, said heel being provided with a stepped recess which is intended to be placed against the end face of the tool support, said device being distinguished by the fact that:

- the clamping member is pivotally mounted on a longitudinal shaft mounted in bearings carried by the tool support,
- on the rear face which is directed towards the face of the tool support, said clamping member has a raised portion in the form of a shoulder located in the zone of the pivotal shaft,
- on the front face which is directed towards the clamping member, the fixing heel of the tool has a recessed portion having a profile which is similar to the raised portion formed on the clamping member of the corresponding fixing device and leaves an end nose which is intended to be applied against a corresponding bearing face formed on the clamping member beyond the raised portion,
- at the end of its opposite face, the fixing heel of the tool has a convex cylindrical surface or a beveled edge inscribed in said surface,
- a movable locking member is intended to be placed against the top portion of the rear face of the clamping member which is directed towards the front face of the tool support after the fixing heel of the tool has been placed in position, thus applying the clamping member against the heel of the tool.

By virtue of this arrangement, a tool of the type under consideration can be fixed in position very rapidly and with a high degree of safety by means of a simple movement which can be performed either by a man or by a robot. In fact, the rotation of the assembly consisting of tool and clamping member automatically places the tool in the work position.

In regard to removal of the tool, this operation can be carried out in two stages as a safety measure, namely a first stage corresponding to slackening of the clamping member but with retention of the tool and a second stage corresponding to extraction of the tool on the front side by means of a movement of rotation in the direction opposite to that of assembly.

In an advantageous embodiment of the device considered, the arrangement is such that the movable locking member is maintained in its withdrawn position when the clamping member is open and is placed automatically in the locking position when the assembly consisting of tool and clamping member has pivoted completely in the direction of closure.

In accordance with a particular feature, said locking member consists of a rotary cam having a shape such that, by rotating about its axis, it is practically in linear contact with the clamping member and tends to produce a progressive outward displacement of the clamping member.

Moreover, the arrangement is such that said locking member is automatically actuated when a thrust is exerted on the tool, thus ensuring instantaneous clamping of said tool.

In a particular embodiment, unclamping is controlled by means of a lever. In such a case, the levers of the different fixing devices provided on one and the same platen of a bending-press can act independently of each other or be connected to each other and connected to a general control unit.

The present invention is also concerned with a tool designed for a bending-press and specially adapted to be mounted on this latter by means of a fixing device as defined earlier. However, the invention is also directed to a bending-press equipped with a fixing device of this type.

DESCRIPTION OF THE PREFERRED EMBODIMENTS

Figure 4:
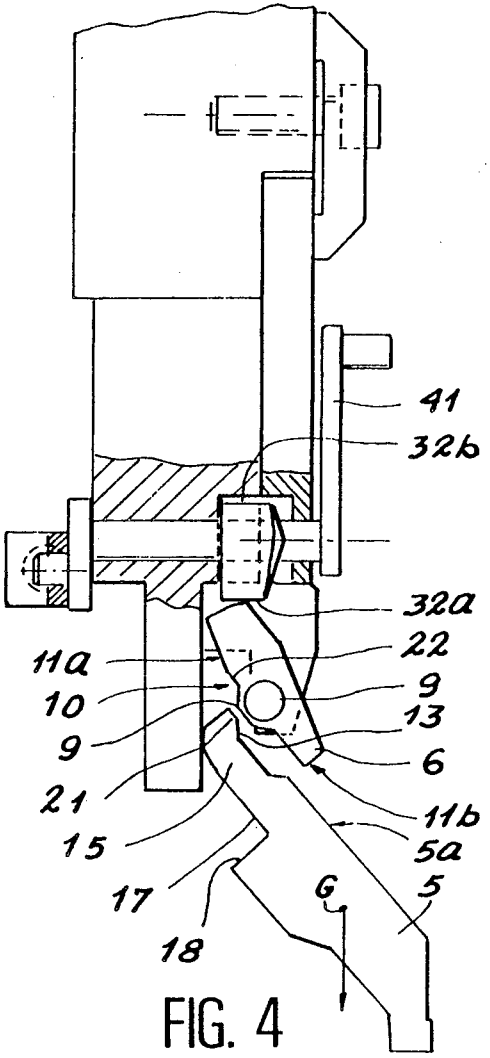
FIG. 4 illustrates the extraction of the tool with the distinctive feature of a setting lever located at the front.

As shown in FIGS. 1, 2, 3 and 4, the upper platen 1 is adapted to receive a series of intermediate tool-holders 2 fixed by means of clamps 3 which are tightly held in position by means of screws 4. In the present state of the technique, this conventional means of clamping is reproduced in most cases for fixing the punch 5 on the tool-holder 2. In this case, the heel of the tool is gripped between the front face 19 of the tool-holder 2 and a clamp which is similar to the clamping member 3.

On the other hand, in the device in accordance with the invention, tightening of the tool-fixing clamping member 6 is carried out differently. Instead of being tightened by means of screws, said clamping member is pivoted about a longitudinal axle 7 which is parallel to the free edge of the tool-holder. Said axle is formed by two journals rotatably mounted in bearings 8*a* and 8*b* fixed on the tool-holder 2.

On the rear face 10 which is directed towards the tool-holder 2, said clamping member 6 has a shoulder 9 which can be of polygonal or cylindrical shape and which is located in the zone of the pivotal axle 7. As is seen in the drawings, this shoulder above the axle 7 is inclined at an acute angle to the lengthwise extent of the elongated clamping member 6. On each side of said shoulder 9, there exist flat surfaces 11*a* and 11*b* which will be placed respectively in contact with a locking member and with the front face of the tool 5. However, the surface 11*a* is separated from the shoulder 9 by the surface 22, the function of which will be explained in detail hereinafter.

The locking member can consist of a rotary locking cam 12 and the arrangement is such that the clamping member 6 produces much the same action as a lever in order to clamp the tool. Moreover, the top end face 24 of the clamping member 6 is a cylindrical surface having a radius R2 centered on the axle 7 or an equivalent polygonal surface. As will be explained below, said surface is intended to serve as a bearing surface for the cam 12 when this latter is in the withdrawn position.

The upper end of the tool 5 has a heel 15, the heel face 5*a* located opposite to the clamping member 6 being provided with a recessed portion 13 having an upper end which is inverse to and has substantially the same profile as the shoulder 9 of the clamping member 6. At the upper end of the corresponding face of the heel 15, said recessed portion 13 leaves a nose 21. The opposite face 17 of the stepped recess 18 located at the base of the heel 15 is extended at its upper end by a cylindrical surface 14 having a radius R1 which is tangent thereto and the center of which is located at the same distance from the face 17 and from the tool shoulder 18 as the axle 7 of the faces 19 and 20 of the tool-holder.

Accordingly, the reference faces of the tool and of the tool-holder coincide when the tool is clamped. Moreover, the nose 21 of the tool is applied against the surface 22 of the clamping member which forms a bearing surface, when the tool is introduced into the tool-holder.

The locking cam 12 is rigidly fixed to a shaft 25 which is in turn connected to a clamping control member. The shape of said cam 12 is such that it can be brought by rotation into a withdrawn position above the clamping member 6 in which a portion 32*a* of its periphery rests against the bearing surface 24 formed on the clamping member whereas, in the clamping position, its active face 30 applies its force against the face 11*a* of said clamping member.

Figure 7:
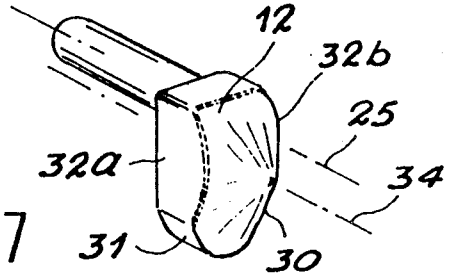
FIG. 7 illustrates a particular embodiment of the cam constituting the locking member.

A particular embodiment of said cam as shown in FIG. 7 consists of a cone 30 limited by two flat faces 32*a* and 32*b* and by a cylindrical surface 31. The axis of rotation 25 is parallel to the axis 34 of the cone and located at a certain distance from this axis. A cam of this type has the property of always having a rectilinear generator-line in a vertical plane irrespective of the angle of rotation and this generator-line progressively moves away from the base of the cone during rotation.

Figure 5:
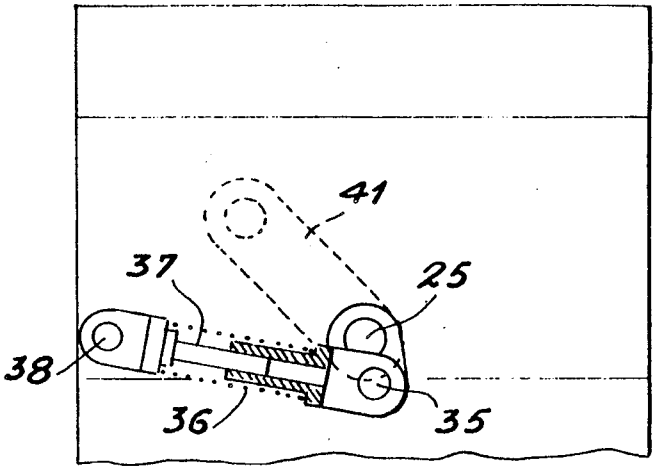
FIG. 5 is a rear view of a system for actuating the cam in the locked position by means of a spring, the spring-setting lever being rigidly fixed to the cam constituting the locking member and said lever being located at the front, as in FIG. 4.
Figure 6:
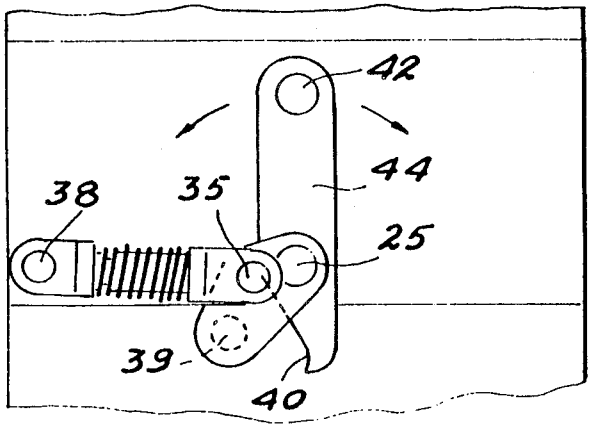
FIG. 6 is a rear view showing a system for actuating said cam in the unlocked position, the spring-setting lever being capable of rotating freely on the axis of the cam as in FIGS. 1 and 3.
Figure 2:
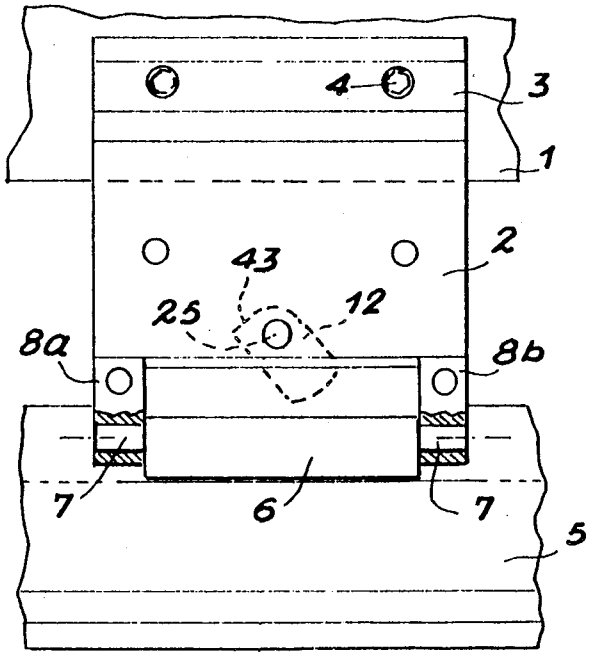
FIG. 2 is a front view of said assembly.

In FIGS. 5 and 6, a mode of actuation of the locking cam 12 is shown by way of non-limitative example. The axis 25 of rotation of said cam passes through the tool-holder 2 and is extended by an eccentric crank-pin 35. A spring 36 coupled to said crank-pin is fitted around a guide 37 pivotally mounted on an axle 38. In this embodiment, the orientation of the crank-pin 35 with respect to the cam 12 is such that the torque exerted on the cam varies in inverse ratio to the compression of the spring. In consequence, the locking cam applies its maximum force in the clamping position whereas it bears only very lightly on the face 24 of the clamping member when it is in the withdrawn position.

Figure 3:
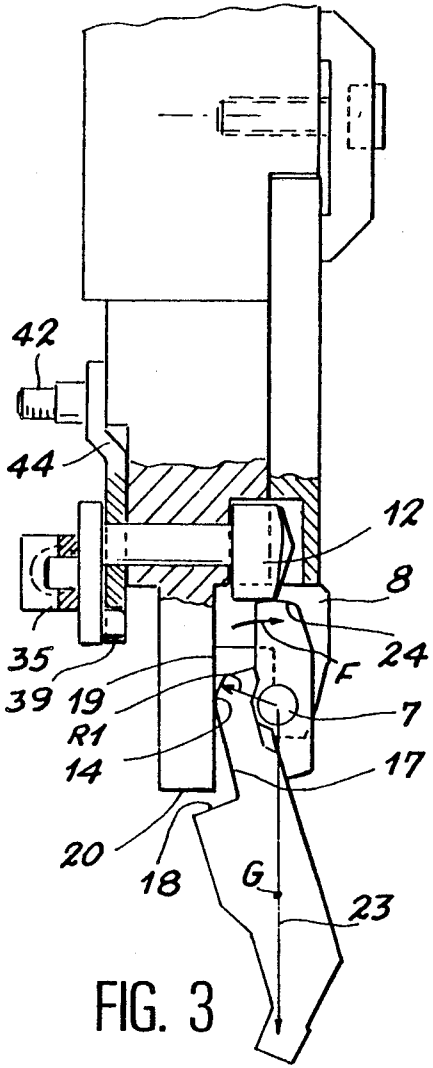
FIG. 3 illustrates the device when the clamping member is slackened-off, the punch being in the so-called safety position.
Figure 1:
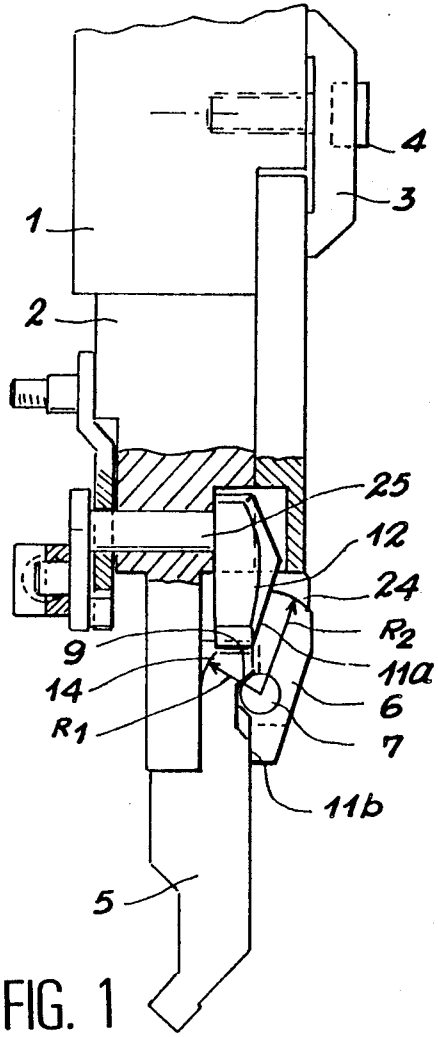
FIG. 1 is a profile view showing by way of example a bending punch mounted on its tool-holder by means of a fixing device in accordance with the invention.

It is therefore apparent that, for the mounting operation, the tool is introduced at the front and from underneath as shown in FIG. 1, then displaced in a rearward pivotal movement until it has engaged as shown in FIG. 3. In order to obtain clamping of the tool as shown in FIG. 1, it is only necessary to continue to pivot the tool in the direction of the arrow F. In fact, the nose 21 of the upper end of the front face of the heel 15 then exerts pressure on the bearing surface 22 provided on the rear face 10 of the clamping member, thus causing it to pivot with the tool in the same direction. During the last stage of this movement, the upper end of the clamping member 6 is moved so as to be located in front of the position of the clamping cam 12. In consequence, said cam is released, rotates about its own axis under the action of the spring 36 and then engages behind the surface 11*a* of the clamping member 6. This accordingly ensures automatic clamping of the fixing heel 15 of the tool, the action of the clamping member 6 being thus the same as that of a lever as stated earlier.

In order to unclamp the tool, it is possible to conceive a variety of different modes of control since it is only necessary to rotate the cam 12 in the direction opposite to the locking direction while compressing the spring 36. It is possible, for example, to employ a lever located either in front of or behind the tool-holder. The operation of this lever can be carried out either separately or by connecting it to the similar levers of identical fixing devices which are mounted on the same tool support. In the case just considered, provision can be made for a general control system.

In a first particular embodiment of the invention as shown in FIGS. 4 and 5, arrangements can be made in particular to ensure that said lever 41 can assume three positions as follows:

(a) A first slackening-off position obtained when compressing the spring 36 by rotating the cam 12 beyond the dead center constituted by alignment of the axes 25, 35 and 38. In this stable position, the edge 43 of the cam 12 engages behind the clamping member with a clearance which permits lateral sliding of the tool.

(b) A second position of extraction in which the face 32*a* of the cam is brought by rotation into a position parallel to the bearing surface 24 formed on the clamping member so as to bear on said surface while permitting rotation of said clamping member and subsequent front extraction of the tool.

(c) The third position of the lever is the position which it assumes automatically under the action of the spring together with the cam when the tool is clamped.

In another particular embodiment of the invention as shown in FIGS. 1, 3 and 6, provision is made for a lever 44 which rotates freely about the axis 25 and bears on a crank-pin 39 in rigidly fixed relation to the crank-pin 35 for compressing the spring. This solution is particularly advantageous for operating the levers of a number of fixing devices by means of a general control system connected to the pivot-pins 42. In fact, in the clamping position, the cams and consequently the crank-pins 35 assume positions which vary from one tool-holder to another by reason of the various factors of dispersion of parts constituting the mechanical assembly.

The examples mentioned do not imply any limitation and any other means may be devised for setting the spring.

It is also apparent that, in order to lock the clamping member, it would also be possible to employ a rotary cam of another type or other means without thereby departing from the scope of the invention. Provision could thus be made for a movable bolt having a locking ramp.

The fixing device in accordance with the invention can be employed either for rigidly suspending an object or for fixing it on its base. In both cases, the device permits fitting in position and removal after pivotal displacement towards the operator, which also has the advantage of avoiding interferences or impacts with other parts located in the same plane and in proximity to the object which is being handled.

It should be noted that the operations of fitting in position and removal of a tool which are permitted by the present fixing device are particularly well suited for handling by robot by reason of the fact that they require only a simple and precise movement.

Moreover, as has already been stated, the invention is also concerned with tools which are intended to equip bending-presses and the heels of which are specially adapted to permit fixing of these tools in position by means of fixing devices in accordance with the invention. In this case, the particular features of the fixing heels of said tools are those of the tool 5 previously described. Finally, the present invention is also concerned with bending-presses equipped with fixing devices as described in the foregoing.

What is claimed is:

1. A device for rigidly fixing a tool of elongated shape such as a punch or die (5) on the platen of a bending-press or on an intermediate support (2), said platen having a vertical surface (19) and a horizontal surface (20) adapted to provide bearing surfaces for two matching reference surfaces (17, 18) of a heel (15) of the tool (5), said device comprising:

a clamping member (6), disposed facing said vertical surface (19) of said support (2) and adapted to grip between itself and said vertical surface (19) said heel (15) of said tool (5), said clamping member (6) being pivotally mounted about a horizontal axle (7) supported in bearings (8*a*, 8*b*) carried by said support (2), for rotation about a horizontal axis of rotation, said clamping member (6) having a raised portion (9) in the form of a shoulder located above said pivotal axle (7), said heel (15) having a recess (13) having a shape matching and receiving said shoulder (9) and terminating endwise in a nose (21) adapted to bear against a corresponding bearing surface (22) on said clamping member (6) above the enlargement (9), said heel (15) having a convex cylindrical surface (14) whose center coincides with said axis of rotation of the clamping member (6) when the tool is in place with said enlargement nested in said heel recess, and a movable locking member adapted to contact an upper portion of said clamping member on the same side of said clamping member as said vertical surface (19), thereby to hold said clamping member (6) against said heel (15) of the tool (5).

2. A fixing device according to claim 1, wherein said clamping member is elongated and said shoulder and recess above said axle are inclined at an acute angle to the lengthwise extent of said elongated clamping member.

3. A fixing device according to claim 1, wherein the movable locking member consists of a cam having the shape of a portion of cone and rotatably mounted about an axis which is parallel to the axis of the cone but displaced with respect to said cone.

4. A fixing device according to claim 1, wherein the displacement of the movable locking member towards its locking position is carried out by means of a spring, the arrangement being such that said spring is unloaded when said locking member is released from its withdrawn position.

5. A fixing device according to claim 3, wherein setting of the spring which produces action on the movable locking member is combined with withdrawal of said locking member, said spring-setting operation being carried out by a suitable control means such as a lever.

6. A fixing device according to claim 4 wherein, in its withdrawn position, the movable locking member rests against a bearing surface which is formed on the clamping member and has a convex cylindrical curvature having a radius R2, the center of which coincides with the axis of rotation of said clamping member.

7. A fixing device according to claim 4, wherein said device is associated with other identical devices distributed with this latter over the entire length of the bending-press, and wherein the means for setting the springs provided in these different devices are connected to a general control system.

8. A fixing device according to claim 3, wherein the locking member has a position in which the clamping member is slackened-off but is capable of only very slight pivotal motion in order to retain the tool which has previously been fixed by means of said clamping member.

9. A bending-press provided with two work platens located one above the other, one of which is movable whilst the other is stationary, wherein at least one platen aforesaid is equipped with a fixing device according to claim 1 for fixing one or a number of tools of elongated shape on said platen.

* * * * *